United States Patent [19]

Akeret

[11] Patent Number: 4,458,427

[45] Date of Patent: Jul. 10, 1984

[54] PROCESS AND DEVICE FOR INTENSIVE HEAT AND MATERIAL TRANSFER

[75] Inventor: Rudolf Akeret, Löhningen, Switzerland

[73] Assignee: Swiss Aluminium Ltd., Chippis, Switzerland

[21] Appl. No.: 389,674

[22] Filed: Jun. 18, 1982

[30] Foreign Application Priority Data

Jun. 25, 1981 [CH] Switzerland ..... 4188/81

[51] Int. Cl.[3] ..... F26B 3/02

[52] U.S. Cl. ..... 34/23; 34/34; 34/107; 34/155; 34/216; 34/242; 432/242; 432/164; 432/194

[58] Field of Search ..... 34/23, 33, 34, 107, 34/155, 156, 216, 217, 242; 432/242, 8, 130, 164, 172, 194

[56] References Cited

U.S. PATENT DOCUMENTS

| | | | |
|---|---|---|---|
| 3,032,890 | 5/1962 | Brick et al. | 34/242 |
| 3,994,678 | 11/1976 | Nelson | 432/145 |
| 4,153,236 | 5/1979 | Elhaus | 34/107 |
| 4,309,167 | 1/1982 | Kurz et al. | 34/242 |

*Primary Examiner*—Larry I. Schwartz
*Attorney, Agent, or Firm*—Bachman and LaPointe

[57] ABSTRACT

A gas flows through a pipe employed for intensive heat and material transfer, wherein the pipe has a length equal to 0.5 to 100 meters. The pipe features a gas inlet and two gas outlets. A solid body charge interacting with the gas flow enters at an inlet position in the pipe, passes a plurality of baffles which reduce the cross section in the pipe, and emerges from the pipe at the end position. Together with the surface of the solid body charge, the baffles form gaps of 3–50 mm which reduce the boundary layer of gas on the charge limiting the heat or material transfer. Between each pair of neighboring baffles are chambers in which the gas rotates and thus strikes the charge repeatedly. As a result the efficiency of material and heat transfer is further improved. With this countercurrent system the solid body can take up and release heat during its passage through the pipe and can take up or release material according to the character of the gas flowing in the inlet.

The main areas of application are however the heating up and drying of a solid charge.

23 Claims, 7 Drawing Figures

PROCESS AND DEVICE FOR INTENSIVE HEAT AND MATERIAL TRANSFER

BACKGROUND OF THE INVENTION

The present invention relates to a process and device for intensive heat and material transfer to elongated solid charges or charges on an elongated substrate.

Various suggestions for improving the thermal efficiency of furnaces and for heating up charges in continuous furnaces are known. In this respect it is known to employ recuperative heat exchangers whcih are situated outside the furnace chamber and make use of the heat from the hot gases leaving the furnace to pre-heat the air for combustion and/or the gaseous fuel.

From the French Pat. No. 2 362 353 it is also known to suck the hot gases repeatedly out of the furnace and to blow them into the furnace again via slit-type nozzles. This method can be used only in connection with heating gas temperatures which can be withstood by the impeller and therefore much lower temperatures than the 1000°–1200° of the flames.

From the German patent application DE-OS No. 26 20 211 it is known that the heat transfer from a heating gas to an elongated charge moving in the opposite direction can be improved by blowing jets of colder secondary gas under pressure onto the charge.

The object of the present invention is to develop a process and device for intensive heat or material transfer between a gas and an elongated, solid system such as individual solid bodies in the form of rod, strip, wire or the like, or a plurality of solid bodies positioned in one or more rows on an elongated support. The heat or material transfer takes place in most cases over the whole length of the above mentioned system, preferably in continuous movement; the process of the invention can however also be advantageously employed to heat up one end of an elongated body which is not moving, for example a metal ingot which is to be extruded.

With the described type of heat or material transfer it can for various reasons be advantageous, apart from intense material or heat transfer, to achieve efficient use of the gas viz., as follows:

(a) For the case of heat transfer from the gas to the solid system, maximum utilization of the heat content of the gas.

(b) For the case of heat removal by the gas from the solid system, heating the gas up to the highest possible exit temperature for possible further use of the extracted heat.

(c) For the case of material transfer from the solid system via the gas, reaching a highest possible concentration of the material in the exiting gas in order to facilitate recovery of the said material or for rendering the same harmless.

(d) For the case of material transfer from the gas to the solid system, minimum possible concentration of residual material in the exiting gas.

SUMMARY OF THE INVENTION

This object is achieved by way of the invention in that the boundary layer on the surface of the solid system, which would strongly inhibit the transfer of heat or material, is reduced by repeated constrication of the path of the gas by means of baffles and by causing the gas circulating in the chamber between the baffles to strike the surface of the solid system repeatedly.

As a result a higher heat and material transfer number between the gas and the solid system is achieved along with a longer delay time of gas in the region where heat or material is transferred.

Continuous operating units are employed e.g. for heating or cooling an elongated solid charge or plurality of solid charges on an elongated substrate, or for a material transfer with the same e.g. drying, moistening, oxidizing, reducing and the like. For such purposes it is generally advantageous to introduce the gas near the point where the solid charge leaves the unit and then to pass the gas past the baffles countercurrent to the movement of the charge.

Each baffle causes a pressure drop of the order of 0.01 bar so that to force the gas past a series of baffles, a pressure difference of the order of 0.1–1 bar is required. For the estimated main application of the process according to the invention viz., the heating up of an elongated solid charge in a continuous furnace, it seems useful to produce this pressure difference by feeding the gaseous or liquid fuel and the necessary air for combustion (and possibly a quantitiy of excess air, if for some reason the temperature of the combustion gases has to be lowered) to a combustion chamber within the heating zone of the furnace, and this under the appropriate pressure. The combustion gases should then flow along the length of the charge past a series of baffles towards both ends of the heating zone so that the positive pressure of the gas is substantially reduced at the furnace ends (charge inlet and outlet ends).

As the heating gas can be utilized to a lower temperature over the furnace length towards the charge inlet end, it is preferred to conduct the greater part of the combustion gas volume towards the inlet end (countercurrent to the charge); the function of the baffles on the side towards the furnace outlet is only to form a labyrinth. These latter baffles also have the secondary function of permitting just enough combustion gas through to keep the surface of the charge hot.

A distribution of the combustion gas streams in the desired amounts can be achieved by appropriate dimensioning of the baffles.

It may be necessary to design individual baffles (preferably the last of these at the inlet and outlet ends) such that the gap between the baffle and the charge can be changed in order to control the pressure drop.

In the particuar case of heat treating thin charges (strip) where there is a danger of local overheating due to direct impingement of the burner on the charge, it may be necessary to arrange the combustion chamber such that the flames do not strike the charge directly; care must be taken that the temperature is uniform throughout the gas stream where this reaches the charge.

Likewise in continuous furnaces for drying purposes, the gas stream is introduced near the point where the dried charge leaves the furnace; the short stretch between the gas inlet point and that point where the dried charge leaves the furnace must be used mainly to hold back or, where possible, to eliminate the undesired fraction of gas flowing in the same direction as the charge.

When extruding metals, it can for various reasons be advantageous to employ billets with a higher temperature in the part next to the die than in the rest of the billet; this enables a reduction in the extrusion load, a lower thermal loading of the die, a higher extrusion speed or easier air removal to be achieved and with that higher productivity.

An arrangement which differs somewhat from those described above is preferred to heat metal extrusion billets hotter at one end than at the other. A chamber which can be closed at one end surrounds the part of the billet which is to be heated to a higher temperature; the combustion chamber is situated at the closed end.

The burners can impinge directly onto the end face of the billet, and the combustion gases flow past a plurality of closely spaced baffles positioned along the length of the billet.

The pipe (R) together with the connecting chamber (B) has a length (L) equal to 0.5 to 100 meters in the direction of the main axis. The baffles are spaced along the length (L) of the pipe at spacings of 0.05 to 0.5 meters, and the gap between the baffles and the charge is from 3 to 50 mm.

BRIEF DESCRIPTION OF THE DRAWINGS

Further features and advantages of the present invention are illustrated in the schematic drawings viz., FIG. 1 Plan view of a continuous heating furnace shown here partly sectioned along the main axis.

DETAILED DESCRIPTION

The charge G to be treated enters furnace pipe R through charge inlet 1, passes through chamber B and emerges via charge outlet 2. In the particular case of heating metal or the like, charge G is heated such that the temperature at the surface 3 is about the same as the temperature in the interior 4.

Figure 1:
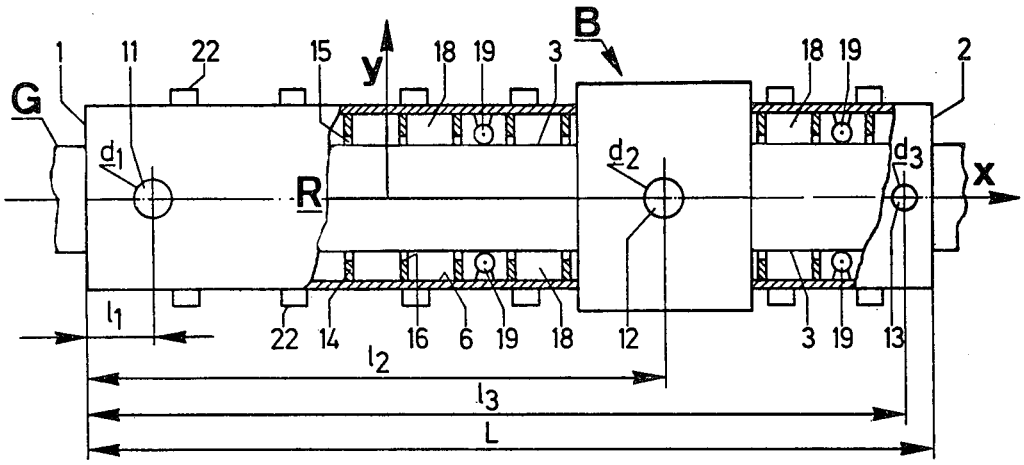
Figure 4:
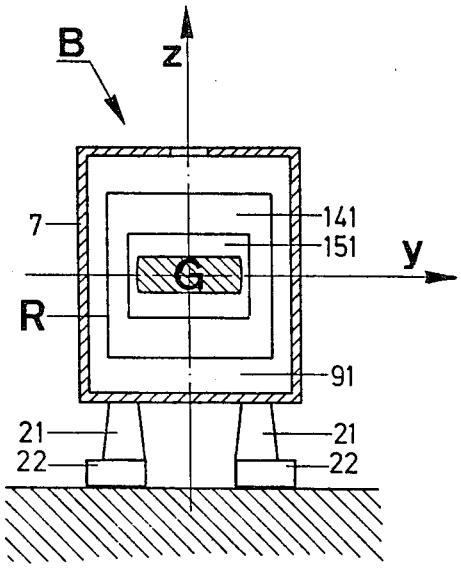
FIG. 4 A cross section along A-A in FIG. 2.

The pipe R in the particular version suitable for an elongated item G is in the form of a box with four walls 5 of insulating material forming a rectangle or square in cross section. Otherwise, the cross section of the pipe R is made to suit the cross section of the charge G. The chamber B, which is to be considered as part of pipe R, has four walls 7 in the special version shown in FIGS. 1, 2 and 4. The front wall 91 and end wall 92 of chamber B are both designed such that the rectangular pipe R fits exactly into openings in these walls 91, 92. The walls 5 of pipe R run parallel to the corresponding wall 7 of chamber B. Combustion chamber B is joined to the heating pipe R by welding or by some other suitable means.

There are no restrictions, within reasonable geometric forms, to the shape of pipe R or chamber B. The length of chamber B, however, is always small compared with the overall length L of pipe R including chamber B. It is recommended that chamber B is not fitted with baffles 14.

At a distance $l_1$ from the charge inlet 1, outlets for the cooled gas are provided in the form of openings 11 of diameter $d_1$. At a distance $l_3$ from the charge inlet 1, near charge outlet 2, is at least one gas outlet 13 of diameter $d_3$ for the rest of the gas to escape. A further opening 12 of diameter $d_2$ is provided in the wall of chamber B at a distance $l_2$ from charge inlet 1; conventional gas burners or pipes feeding gas from outside can be fitted to this opening 12.

The gas flowing into chamber B via opening 12 does not distribute itself uniformly over the charge G. The part of the charge G in the region prior to chamber B experiences a greater mass of the gas than the part near the charge outlet end of the pipe R, which indicates that the diameter $d_3$ of the gas outlet 13 is smaller than diameter $d_1$ of gas outlet 11.

It is preferred that only a small mass of the hardly cooled gas escapes via outlet 13 and a greater part of the cooled gas escapes through outlet 11.

The charge passes a plurality of baffles 14 arranged on the inner wall 6 of pipe R. The gaps 15 of baffles 14 are formed by the inner edges 16 of baffles 14 and surface 3 of the charge.

The gaps 15 between the charge inlet 1 and chamber B are larger than those between chamber B and outlet 2, as a result of which the resistance to gas flow is smaller in the direction towards the charge inlet end than towards the charge outlet end.

The gaps 15 at the entrance 1 and outlet 2 are also smaller than the other gaps formed by the baffles.

This causes the larger mass of heating gas to flow towards the charge inlet end of pipe R. Between the baffles 141 and 142 this gas begins to rotate so that the same hot gas repeatedly flows over the charge; the result is an improvement in heat transfer to the charge due to a partial break down of the boundary layer and by limiting its thickness to the size of the gaps 152, 151. The same gas circulation occurs basically up to the last of the chambers formed by neighboring baffles 14.

Figure 2:
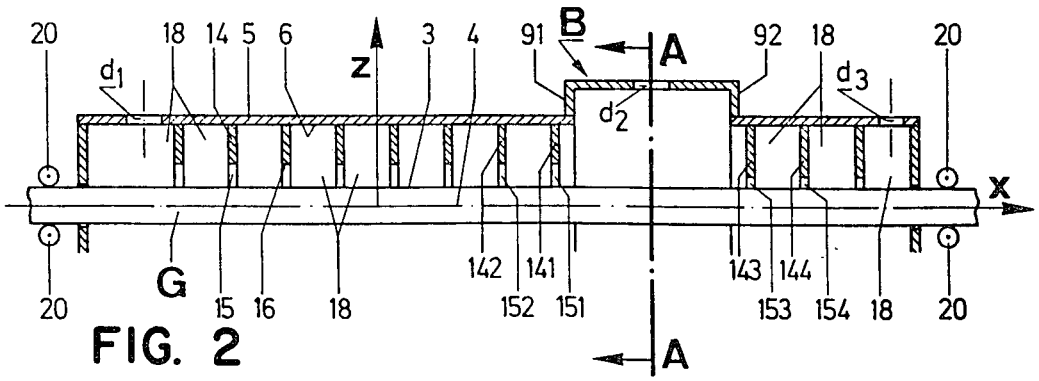
FIG. 2 Longitudinal section partly through the main axis ofating furnace.

The above described circulation of heating gas also occurs on the side of chamber B leading to the charge outlet 2. The baffle 143 closest to chamber B forms a much narrower gap 153 than baffle 141. The gap 154 formed by the next baffle 144 is approximately the same as that formed by baffle 143 (FIG. 2). The flow of gas from chamber B is therefore restricted, which results in a much smaller amount of gas flowing in the same direction as the charge than counter to it.

Figure 3:
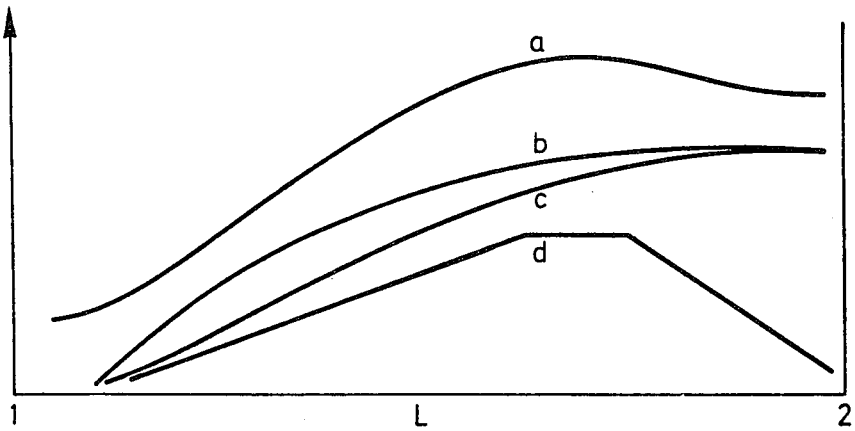
FIG. 3 A diagramm showing the change in some parameters relating to the charge and the heating gas over length (L) of a continuous heating furnace.

FIG. 3 illustrates the charge in certain parameters over the whole length of the furnace. Positions 1 and 2 represent the charge inlet and outlet points resp. where charge G enters or leaves the furnace. The approximate temperature of the charge is indicated by the letter a; the pressure (positive pressure ) of the heating gas entering at 12 is indicated by d, the temperature at the surface 3 of the charge by b, and the temperature in the interior of the charge by c. As can be seen there, the curves b and c overlap at the end of heating length L. To prevent the baffles 14 being damaged at the sides, bearing elements 19 can be provided on the inner wall 6 between neighboring baffles. Elements 20 which span the charge G serve the same purpose, and at the same time advance the charge in direction X. The pipe R rests on legs 21 supported on bases 22 set on the same plane.

Figure 5:
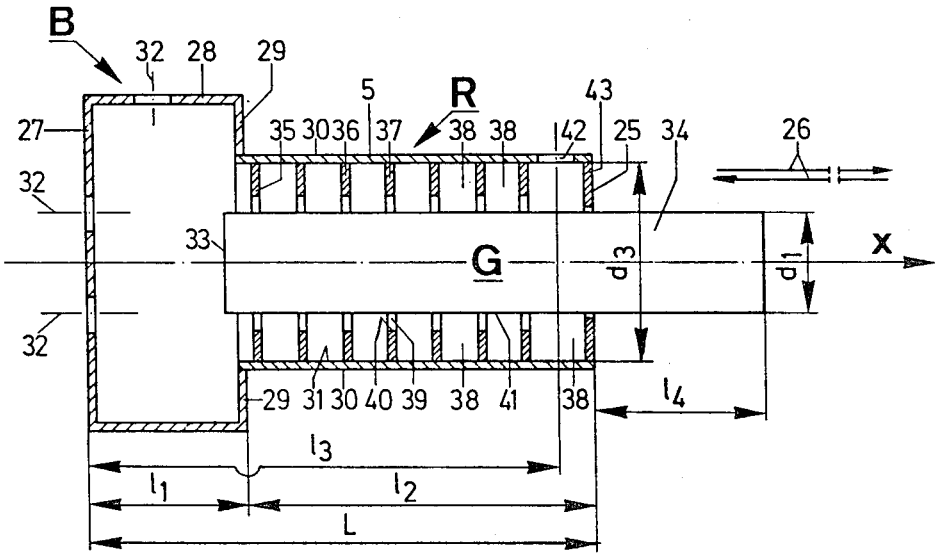
FIG. 5 Longitudinal cross section through a furnace with one opening for charging and discharging.

For reasons of clarity, in FIG. 5, all parts (e.g. legs, supporting rollers etc.) which are not directly part of the invention per se have been omitted.

The heating pipe R of length L is made up of a combustion chamber B of length $l_1$ and pipe R of length $l_2$. Charge G, which is round in cross section in this case, is of diameter $d_1$ and is arranged concentric to the main axis X; it projects a length $l_4$ beyond the entrance 25 which is at the same time also the exist. The charge is conveyed to the furnace chamber R and held there until it has reached a temperature which is suitable for extrusion. The movements 26 of the grips transporting the charge are only indicated.

The combustion chamber B comprises basically a floor 27, wall 28 of length $l_1$ running concentric to the X axis and wall 29 which meets up with pipe R (outside 30, inner face 31) of diameter $d_3$. All walls are of course thermally insulated. The end 27 or sidewall 28 of the combustion chamber B features openings 32 which can accommodate a burner to combust conventional fuels in air to form a gaseous heating medium, or which can accept pipes feeding heating gas into the combustion chamber. It is recommended not to provide chamber B with baffles.

The hot gas coming from chamber B directly strikes the front end 33 of the extrusion billet and, as a result of the baffles 35 on the inner wall 31 of pipe R, is forced to circulate in chambers 38 between pairs of baffles 36 and 37 as described above. The size of gap 39 is determined by the inner edge 40 of baffle 35 and the outer face of billet 34. In the example shown in FIG. 5 all the gaps 39 are of the same size, apart from the gap formed by baffle 43 terminating the furnace R, which is narrower than the others. Shortly before the end 25 of the furnace R is an opening 42 in the wall, through which the cooled heating gas can escape to the surroundings.

Figure 7:
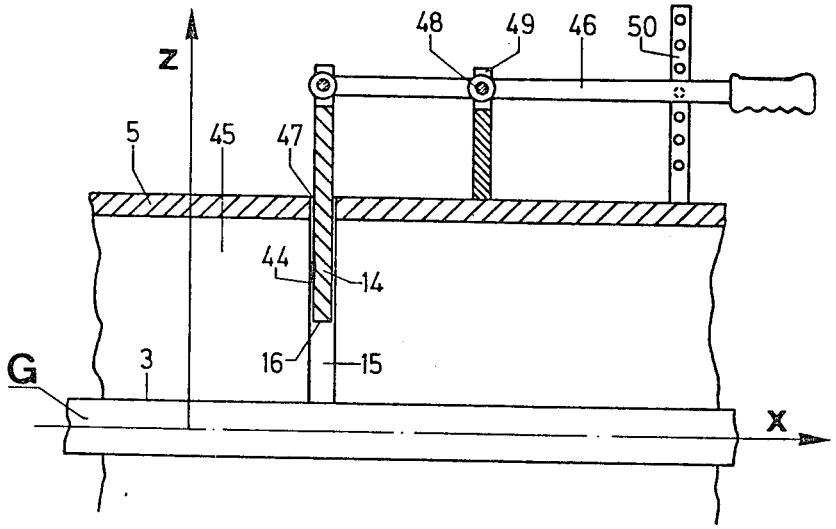
FIG. 7 A longitudinal section through part of a continuous heating furnace showing a gap for the heating gas, adjustable by means of a baffle.

Another means of influencing the flow of heating medium is a device (FIG. 7) which allows the baffles 14, 35, to be adjusted mechanically so that the gap 15, 39 in question can be either opened wider or made narrower. For example, the baffle 14, 35 is passed through channels 44 on parallel, opposite-lying inner faces 45 of pipe R and pushed through opening 47 in wall 5 by means of a lever rod 46 hinged to the baffle 14, 35. The rod 46 is part of a two-armed lever which pivots at point 48 on a support 49 mounted on the wall 5 of the furnace R. On the right hand side of FIG. 7 is the longer part of the arm 46 which can be engaged with a rod 50 or the like which features a series of holes.

Figure 6:
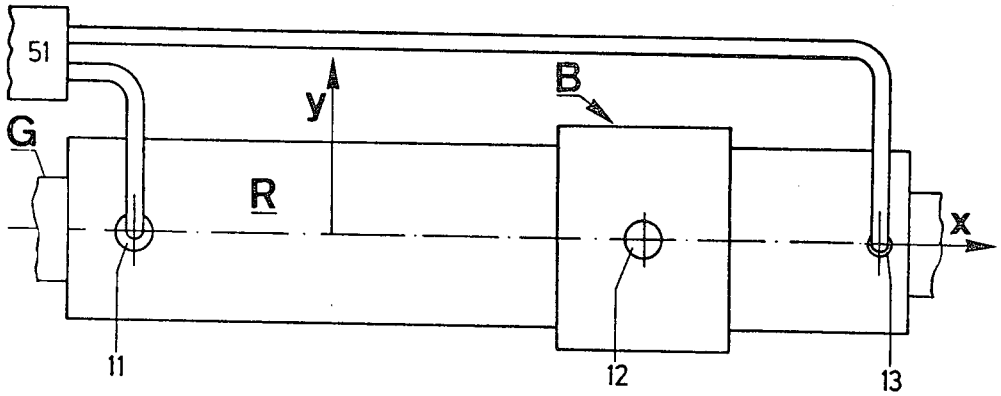
FIG. 6 Plan view of a continuous heating furnace.

As the same principle also holds for intensive exchange of material, processes and devices according to the invention are also suitable for that purpose. When, for example, a coat of paint is to be dried, the vapors given off can often cause damage to health such as skin diseases, bronchial problems and allergies affecting the skin and respiratory system. Consequently the aggressive vapors given off during drying may not be released to the surrounding air. In this case the vapors are led off together with the drying gas via pipes attached to openings 11, 13 to a device 51 in which the aggressive vapors are rendered harmless (FIG. 6). The device 51 can also be designed such that the heat in the gas leaving the pipe R can be used further.

What is claimed is:

1. Process for intensive exchange between a gas and an elongated solid charge which comprises: providing an elongated pipe; positioning said charge within said pipe such that the charge is surrounded thereby; flowing gas through said pipe, wherein said gas enters said pipe within its length and is removed at least at one end; and providing a plurality of baffles inside said pipe extending inwardly towards said charge dividing said pipe into connecting chambers, wherein said baffles are spaced from the charge and form a gap between the charge and the baffles, whereby the cross sectional area between the baffles and the charge is less than the cross sectional area between the pipe and the charge and whereby as the gas passes from one chamber to the next, the thickness of the boundary layer adjacent the charge restricting heat and mass transfer is reduced corresponding to the width of the gap, and whereby the gas circulates repeatedly over the charge in each chamber thereby favoring heat or mass transfer.

2. Process according to claim 1 wherein the pipe has a length of 0.5 to 100 meters in the direction of the main axis.

3. Process according to claim 2 wherein the baffles are spaced along the length of the pipe at spacings of 0.05 to 0.5 meters.

4. Process according to claim 3 wherein the gap between the baffles and the charge is from 3 to 50 mm.

5. Process according to claim 4 wherein said pipe has an inlet end and an outlet end.

6. Process according to claim 5 wherein hot gas enters said pipe within its length and is removed at both ends thereof, with a fraction thereof flowing towards the inlet end and a fraction thereof flowing towards the outlet end, wherein said gas flows in two directions with the fraction thereof flowing with the heated charge towards the outlet end being smaller than the fraction thereof flowing towards the inlet end.

7. Process according to claim 6 wherein the ratio of mass flow of the two fractions of heating gas is the result of different resistance to flow of gas from the point of entry thereof to the inlet end on the one hand and from the point of entry thereof to the outlet end, wherein said difference in resistance is achieved by appropriate choice of the number and size of said gaps.

8. Process according to claim 1 for heating up one end of a full or hollow, round or prismatic rod, with said pipe being closed at one end thereof and with heating gas being fed in at said closed end, wherein said gas strikes the end of the rod and flows along the sides thereof through a series of said chambers and past a plurality of said baffles.

9. Process according to claim 5 for continuously cooling, drying or moistening an elongated solid body or a plurality of solid bodies on a support wherein said gas enters near said outlet and flow countercurrent to the direction of movement of the charge.

10. Device for intensive exchange between a gas and an elongated solid charge which comprises: an elongated pipe; an elongated solid charge positioned within said pipe and surrounded thereby; means associated with said pipe for flowing gas through said pipe and around said charge, wherein said means includes means for introducing said gas into said pipe within the length of said pipe and means for removal of said gas at least at one end of said pipe; and a plurality of baffles inside said pipe extending inwardly towards said charge dividing said pipe into connecting chambers, wherein said baffles are spaced from the charge and form a gap between the charge and the baffles, whereby the cross sectional area between the baffles and the charge is less than the cross sectional area between the pipe and the charge and whereby as the gas passes from one chamber to the next, the thickness of the boundary layer adjacent the charge restricting heat and mass transfer is reduced corresponding to the width of the gap, and whereby the gas circulates repeatedly over the charge in each chamber thereby favoring heat or mass transfer.

11. Device according to claim 10 wherein said charge comprises a plurality of elongated solid bodies on an elongated support.

12. Device according to claim 10 including means for conveying said charge through said pipe.

13. Device according to claim 10 including a chamber connected to said pipe for supplying said gas.

14. Device according to claim 13 wherein said pipe has a length of 0.5 to 100 meters in the direction of the main axis.

15. Device according to claim 14 wherein the baffles are spaced along the length of the pipe at spacings of 0.05 to 0.5 meters.

16. Device according to claim 15 wherein the gap between the baffles and the charge is from 3 to 50 mm.

17. Device according to claim 16 wherein said pipe has an inlet end and an outlet end.

18. Device according to claim 17 including at least one opening in said pipe adjacent the inlet end and at least one opening in said pipe adjacent the outlet end, wherein the opening adjacent the inlet end is larger than the opening adjacent the outlet end.

19. Device according to claim 13 including at least one opening in said chamber.

20. Device according to claim 19 wherein at least one of said baffles passes through an opening in the pipe wall and is movable in a channel by means of a mechanism in the form of a two armed lever, the longer arm of which can be engaged on a rod in a series of positions to adjust the height of the baffle.

21. Device according to claim 17 wherein between said chamber and said inlet, the baffles provide larger gaps than the baffles between said chamber and said oulet.

22. Device according to claim 10 wherein adjacent the ends of said pipe, said baffles form gaps which are narrower than the gaps formed by the other baffles.

23. Device according to claim 13 wherein the diameter of said chamber is larger than that of said pipe and wherein said chamber is not fitted with baffles.

* * * * *

UNITED STATES PATENT AND TRADEMARK OFFICE

CERTIFICATE OF CORRECTION

PATENT NO. : 4,458,427

DATED : July 10, 1984

INVENTOR(S) : Rudolf Akeret

It is certified that error appears in the above-identified patent and that said Letters Patent are hereby corrected as shown below:

Column 1, line 12, change "whcih" to read ---which---.

Column 1, line 67, change "constrication" to read ---constriction---.

Column 3, line 26, after "axis" change "ofating" to read ---of a continuous heating---.

Column 6, line 43, claim 9, change "flow" to read ---flows---.

Column 8, line 3, claim 20, change "claim 19" to read ---claim 10---.

Signed and Sealed this

*Twenty-ninth* Day of *January 1985*

[SEAL]

*Attest:*

DONALD J. QUIGG

*Attesting Officer* *Acting Commissioner of Patents and Trademarks*